US011267678B2

(12) United States Patent
Kinjarapu et al.

(10) Patent No.: US 11,267,678 B2
(45) Date of Patent: Mar. 8, 2022

(54) ELEVATOR CAR INSTALLATION INCLUDING CAR ROOF SAFETY LATCH

(71) Applicant: KONE Corporation, Helsinki (FI)

(72) Inventors: Arvind Kinjarapu, Allen, TX (US); Håkan Bärneman, Frisco, TX (US); Hector Garcia, Matamoros (MX); Areli Borrego, Helsinki (MX); Martti Juurioksa, Allen, TX (US)

(73) Assignee: KONE CORPORATION, Helsinki (FI)

( * ) Notice: Subject to any disclaimer, the term of this patent is extended or adjusted under 35 U.S.C. 154(b) by 9 days.

(21) Appl. No.: 16/827,229

(22) Filed: Mar. 23, 2020

(65) Prior Publication Data

US 2021/0292128 A1 Sep. 23, 2021

(51) Int. Cl.
*B66B 11/02* (2006.01)
*B66B 7/02* (2006.01)

(52) U.S. Cl.
CPC ..... *B66B 11/0226* (2013.01); *B66B 7/023* (2013.01); *B66B 11/0206* (2013.01)

(58) Field of Classification Search
CPC . B66B 11/0226; B66B 11/0206; B66B 11/02; E04B 1/34363; E04B 1/34384;
(Continued)

(56) References Cited

U.S. PATENT DOCUMENTS 2,490,652 A 12/1949 Sahlin
3,191,721 A * 6/1965 Conry ..... B66B 11/0226 187/401

(Continued)

FOREIGN PATENT DOCUMENTS

CN 108910662 A * 11/2018
CN 110203798 A * 9/2019 ..... B66B 5/00

(Continued)

OTHER PUBLICATIONS

Maruyama, Naoyuki, Body Assembled from Elevator Car Components, Method for Manufacturing Car, and Elevator Car, Jun. 30, 2016, Machine translation of the description of WO-2016103391-A1 (Year: 2016).*

(Continued)

*Primary Examiner* — Michael R Mansen
*Assistant Examiner* — Michelle M Lantrip
(74) *Attorney, Agent, or Firm* — Birch, Stewart, Kolasch & Birch, LLP

(57) ABSTRACT

A method of assembling an elevator car within an elevator hoistway, including installing a car frame onto the elevator hoistway, attaching a car base to the car frame, the car base forming a floor of the elevator car, setting spacers on a top surface of the car base, placing a car roof onto the spacers, the car roof including a first bracket and a second bracket, each bracket including a safety latch assembly, lifting the car roof until to a top position where each safety latch assembly engages a respective top surface of the car frame to fix the car roof to the car frame, the installing wall panels to the car base and to the car roof. As the car roof is lifted, the safety latches travel along a car frame structural vertical member and are maintained in a tensioned state by springs.

17 Claims, 10 Drawing Sheets

(58) Field of Classification Search
CPC ..... E04B 1/3522; E04B 1/5818; E04B 2001/2644; B66F 2700/123
See application file for complete search history.

(56) References Cited

U.S. PATENT DOCUMENTS

| | | | | |
|---|---|---|---|---|
| 4,430,835 | A | 2/1984 | Ericson | |
| 4,779,707 | A | 10/1988 | Smith et al. | |
| 4,865,157 | A | 9/1989 | Sissala | |
| 4,875,553 | A | 10/1989 | Smith et al. | |
| 1,907,967 | A | 5/1993 | Himes | |
| 5,325,937 | A | 7/1994 | Suchodolski et al. | |
| 5,564,529 | A | 10/1996 | Ericson et al. | |
| 6,668,980 | B2 | 12/2003 | Smith | |
| 8,104,587 | B2 | 1/2012 | Starace | |
| 9,540,215 | B2 | 1/2017 | Hawkins et al. | |
| 9,592,997 | B2 | 3/2017 | Mertala | |
| 9,776,831 | B2 | 10/2017 | Manner et al. | |
| 10,246,304 | B2 | 4/2019 | Ahoniemi et al. | |
| 10,252,890 | B2 | 4/2019 | Ratia et al. | |
| 10,294,073 | B2 | 5/2019 | Haapaniemi et al. | |
| 2002/0066622 | A1 | 6/2002 | Pettersson et al. | |
| 2007/0089936 | A1 | 4/2007 | Zeng et al. | |
| 2009/0057070 | A1* | 3/2009 | Maury | B66B 11/0226 187/401 |
| 2010/0018809 | A1 | 1/2010 | Peacock et al. | |
| 2011/0100763 | A1 | 5/2011 | Wiacek et al. | |
| 2012/0023863 | A1 | 2/2012 | Van Der Meijden et al. | |
| 2012/0085032 | A1* | 4/2012 | Heikintupa | E04B 9/003 49/104 |
| 2013/0220742 | A1 | 8/2013 | Mielonen et al. | |
| 2013/0233655 | A1 | 9/2013 | Peacock et al. | |
| 2013/0327599 | A1 | 12/2013 | Somma et al. | |
| 2018/0370769 | A1* | 12/2018 | Haivala | B66B 11/0206 |
| 2019/0330023 | A1* | 10/2019 | Fauconnet | B66B 11/0206 |
| 2020/0331726 | A1* | 10/2020 | Jagdale | B66B 11/0226 |

FOREIGN PATENT DOCUMENTS

| | | | | |
|---|---|---|---|---|
| EP | 2179958 | A1 * | 4/2010 | B66B 11/0226 |
| EP | 3395741 | A1 * | 10/2018 | B66B 5/0087 |
| WO | WO 96/16893 | A1 | 6/1996 | |
| WO | WO 00/37350 | A1 | 6/2000 | |
| WO | WO 01/98194 | A1 | 12/2001 | |
| WO | WO-2016103391 | A1 * | 6/2016 | B66B 11/0226 |
| WO | WO 2017/063702 | A1 | 4/2017 | |
| WO | WO-2020148855 | A1 * | 7/2020 | B66B 5/00 |

OTHER PUBLICATIONS

Fukuoka, Hiroki et al., Elevator Car, Jul. 23, 2020, Machine translation of the description of WO-2020148855-A1 (Year: 2020).*

* cited by examiner

ELEVATOR CAR INSTALLATION INCLUDING CAR ROOF SAFETY LATCH

BACKGROUND OF THE INVENTION

1. Field of Invention

The present invention is directed to the assembly of an elevator car within an elevator hoistway.

2. Description of the Background Art

The prior art method for assembling an elevator car is as follows. Firstly, the car base is provided in the elevator hoistway. Then, wall panels are attached to the platform, and lastly, the roof is attached to the wall panels. U.S. Pat. No. 4,875,553 (herein "Smith") and U.S. Pat. No. 8,104,587 (herein "Starace") are incorporated herein by reference in their entirety to disclose prior art methods for assembling an elevator car within a hoistway. For instance, Smith discloses "hanger means" provided on the backside of adjacent wall panels for assembling the panels in the proper right-angular juxtaposition (Smith column 4, lines 3-7). Further, Starace discloses a plurality of floor, wall and roof panels joined together "by means of plug connections and with a few screw connections" (Starace Abstract).

Elevator cars conventionally comprise a load-bearing frame structure, (e.g., a car sling, elevator car frame) having a lower horizontal beam and an upper horizontal beam, vertical beams on opposing sides of an elevator hoistway and each of the lower horizontal beam, upper horizontal beam, and vertical beams being connected to each other to form a closed loop. Within the closed loop, an elevator car (e.g., car box) is installed. US 2013/0327599 (herein "Somma"), which is incorporated by reference in its entirety, describes a method of assembling an elevator car, which has an "interior that can receive goods and/or passengers for conveying them in the interior of the elevator car" (Somma paragraph [0002]). Further, Somma, in paragraph [0003], discloses "[t]he outer surface of the roof of the elevator car can be formed from plates that are firmly and permanently supported on the upper horizontal beam system . . . [t]he ceiling panel can be a single-piece or multi-piece ceiling panel, and the bottom surface of it forms a flat surface bounding the interior of the car."

The background art fails to address the safety of an individual (e.g., user, installer, worker) during assembly of the wall panels. That is, during assembly of the wall panels, the individuals are susceptible to falling debris from within the elevator hoistway, that can cause serious injury.

The present invention improves safety to the individual of the elevator car by installing the elevator car roof prior to installing the wall panels, through the use of a safety latch system, which aids in the installation of the roof.

Further, the present invention involves the assembling of kick plates and railing to the elevator car roof prior to assembling the car roof in order to improve the safety of individuals standing on the car roof during assembly of other elevator components, such as electrical components, landings, hoists, motors, cables, pulleys, and the like.

SUMMARY OF THE INVENTION

The present invention is directed to assembling an elevator car within an elevator hoistway, while providing improved safety to the individuals.

An elevator car frame is installed within an elevator hoistway, which may be attached to guiderails 20, 25 pre-installed in the elevator hoistway, then an elevator car base (e.g., elevator car floor) is attached to the car frame (e.g., car sling), and thereafter, a roof of the elevator car is attached to the car frame. The guiderails 20, 25 may be installed in the elevator hoistway, for example, by fasteners (e.g., bolts, screw) or by any known means. The elevator car frame may be connected to the guiderails 20, 25 and may be movable with respect to the guide rails. During installation of the car roof to the car frame, the car frame may be temporarily fixed in place, such as being suspended by cables or the like, or attached to the guiderails 20, 25 by fasteners, such as bolts or screws.

Further, the car base may be fixed to the car frame (e.g., car sling) by any known means, such as in the manner described in US 2013/0220742 (herein "Mielonen"), which is incorporated by reference in its entirety. For instance, the car base may be connected to vertical frame members 42, 44 and angled frame members 6 of the car frame (Mielonen paragraph [0082]).

Alternatively, the car base may be attached within the hoistway by any known manner, such as described in U.S. Pat. No. 9,776,831 (herein "Manner"), which is incorporated by reference in its entirety.

According to the present invention, a car frame is attached to guiderails 20, 25 within an elevator hoistway. The car frame may be installed at a lower-most point of the hoistway, or may be located at any position along the hoistway. Thereafter, the car base is attached to the car frame by fasteners or by any known means, such as described above. Thereafter, one or more spacers are placed on a top surface of the car base for receiving a car roof. Thereafter, the car roof is roof is placed on the one or more spacers of the car base.

The car roof may be provided with kick plates that are rotatable connected to the car roof. When the car roof is placed on the one or more spacers, the kick plates may be moved from a closed position that is parallel (or at least substantially parallel) with a top surface of the car roof, to an open position that is perpendicular to the top surface of the car roof. The kick plates may surround an entire periphery of the top surface of the car roof, or may surround only a portion of the periphery of the top surface of the car roof. Further, the car roof may be provided with a single kick plate that extends the entire periphery of the top surface of the car roof or a single kick plate that extends a portion of the periphery of the top surface of the car roof.

Once rotated to its open position, the kick plates (or kick plate) are fixed in place, for instance, by fasteners or the like. Alternatively, the kick plates (or kick plate) may be rotated into a groove of the top surface of the roof and include a latch to be locked into place.

Before or after the kick plates are moved and fixed to their open position, hand railing (e.g., balusters) may be installed to the top surface of the car roof, which is used for protecting individuals from falling. That is, the hand railing may extend a predetermined distance from the car roof in the vertical direction to protect an individual from falling from the elevator roof.

Specifically, during the construction/installation phase of the elevator, individuals may be required to stand on the car roof to install various items, such as extending the guide rails, installing the elevator hoist, installing the machine room, installing an elevator landing (including with landing doors), and/or installing any other elevator related component. During such an installation, individuals are susceptible to a fall (e.g., may fall from the elevator car roof), and the railing/balusters protect the individuals from falling. Further, the kick plates also provide protection to the feet of the individuals, and are used to ensure items that are dropped from the individuals are contained within the car roof and do not fall from the car roof. That is, if an items is dropped within the car roof, the kick plates help to block the items from falling down the hoistway. The kick plates may alternately cover only three sides of the car roof.

When the car roof is set on the one or more spacers, brackets are attached to the car roof. Each bracket has a safety latch for engaging a respective vertical frame member of the car frame to hold the car roof in place, once the car roof is lifted to a predetermined position. That is, a first bracket installed on a first side of the car roof engages a first vertical frame member and a second bracket installed on a second side of the car roof, opposite to the first side of the car roof, engages a second vertical frame member. Each bracket safety latch has a groove for engaging the respective one of the first and second vertical frame members and a spring for biasing the safety latch in position.

After the assembly/installation of the brackets to the car roof, rotating and fixing the kick plates to their open position and installing the balusters/railing, the car roof is lifted (for example, using a crane, hoist or the like) to a top position of the car frame to be fixed to a top portion of the car frame. While the car roof is being raised, each safety latch may drag against the respective one of the first and second vertical frame members.

When the car roof is lifted/moved to the top position, the two safety latches fixedly and removably engage a top portion of the car frame to fix the car roof to the car frame. Thus, an individual is able to safely install the elevator car wall panels while being protected by the car roof.

Once each safety latch engages the respective vertical frame member, the car roof may be further fastened to the car frame by fasteners, such as bolts or screws, and then wall panels are attached to the car roof and to the car base.

After the wall panels are attached to the car roof and the to the car base, the car base may be made movable with respect to the guide rails to allow the elevator car to move within the hoistway.

By attaching the car roof prior to assembling the car wall panels to the car base, safety of an individual is improved. That is, during installation of an elevator car within an elevator hoistway, individual(s) are in danger of being struck by falling objects, which can cause great bodily harm to the individual(s). To improve safety and minimize the exposure to safety threats, such as falling debris or the elements/components of the elevator, a car roof is installed in the elevator hoistway prior to installing the wall panels, and the car roof is provided with safety latches that respectively engage a top portion of the car frame to fix the car roof to the car frame. That way, during installation of the wall panels, the individual(s) are protected by the car roof from falling objects.

Further, the safety latches of the present invention allow for automatically forming a mechanical connection between the car roof and the car frame, thus obviating the need for a user to manually latch or connect the car roof while the car roof is being suspended at a particular position.

While the roof is raised, the safety latches travel along the respective vertical frame member and are maintained in a tensioned state by a respective spring, which may be designated as a non-engaged state.

A lifting device may be used to lift the car roof to the top position. Thus, the spring activated safety latch of the car roof engages the car frame vertical frame members 42, 44 to form a mechanical connection to add an additional layer of safety, in case the lifting device fails. This allows the individuals to safely work under the roof to install the wall panels.

After assembly of the elevator car within the hoistway, a hoist is attached to the elevator car, ropes are attached to diverter pulleys of the elevator car, and a drive machine (e.g., drive motor, as known in the art) and a traction sheave are assembled in the elevator hoistway for driving the elevator car. The elevator assembly may be installed within the elevator hoistway in the manner described in US 2002/0066622 (herein "Pettersson"), which is incorporated by reference in its entirety.

After attachment of the hoist to the elevator car, the temporary fixing means of the car base to the guide rails may be removed (e.g., disconnected), to allow the elevator car to move with respect to the guiderails for normal elevator operation, by the drive machine.

The car base is first attached to guide rails of the elevator hoistway. U.S. Pat. No. 9,592,997, which is incorporated by reference in its entirety, describes the process for attaching guides rails attached to an elevator hoistway, and attaching a car base to the guide rails, during installation of an elevator.

Further scope of applicability of the invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
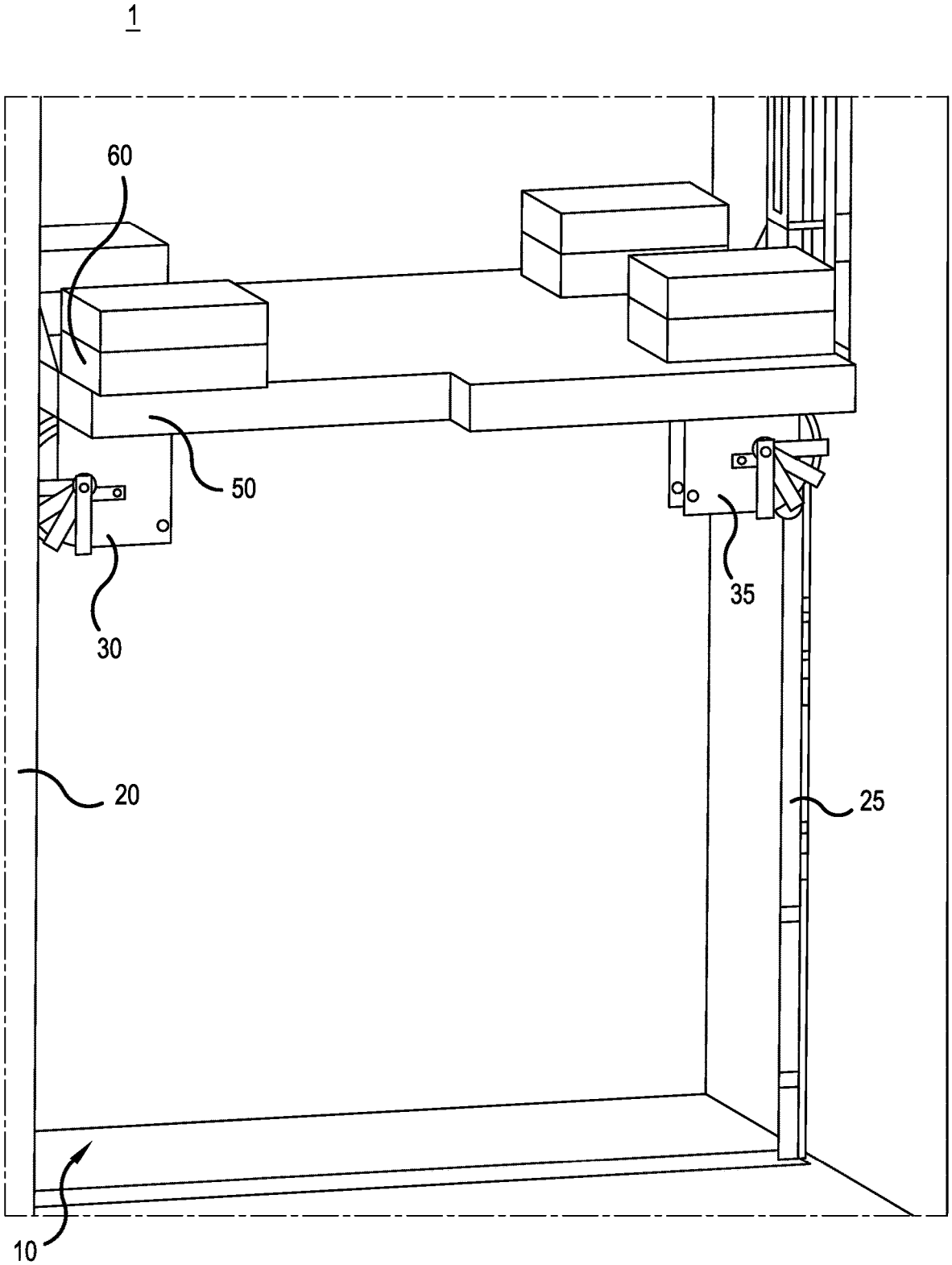
FIG. 1 is a perspective view of an elevator car base assembled to an elevator car frame (i.e., sling) within an elevator hoistway and having spacers thereon.

The present invention will now be described with reference to the accompanying drawings, wherein the same reference numerals have been used to identify the same or similar elements throughout the several views.

FIG. 1 is a perspective view of an elevator 1 including an elevator car base 50 assembled to an elevator car frame 40 (i.e., car sling, see FIG. 2) within an elevator hoistway 10 and having spacers 60 thereon. The car base 50 may include two diverter pulleys 30, 35, as shown in FIG. 1, as known in the art, for receiving a drive belt or rope for moving the elevator within the hoistway 10.

Further, the elevator car frame 40 may be temporarily fixed to guide rails installed within the hoistway 10, including by being suspended by a cable or other means, or by being fastened to the guiderails 20, 25 using fasteners. That is, the elevator car frame 40 may be temporarily fixed to the guide rails to restrict movement of the car frame 40 with respect to the guide rails during assembly of the elevator car, including the roof and wall panels.

After assembly of the elevator car, the temporary fixing means (i.e., suspension by cable or other means or fasteners) can be removed, and the car frame 40 can be free to move with respect to the guide rails 20, 25 to allow for normal elevator operation. That is, after assembly of the elevator car, and after attachment of a hoist to a surface of the elevator car (such as a top surface of the elevator car) and positioning at least one drive rope over at least one diverter pulley 30, 35, the temporary fixing means (i.e., suspension by cable or other means or fasteners) can be removed, and the car frame 40 can be free to move with respect to the guide rails 20, 25 to allow for normal elevator operation. Any number of diverter pulleys 30, 35 may be attached to the elevator car.

The car base 50 may be fixed to the car frame 40 by any known means, such as by bolts, screws, rivets, brazing, welding or the like. Further, at least one spacer 60, which may be made out of any material, such as rubber, elastomer, cardboard or other paper products, or the like, may be placed on a top surface of the car base 50 for receiving the car roof 100 (See FIG. 2). There may be a plurality of spacers 60 positioned on the top surface of the car base 50, including multiple spacers 60 at each corner among four corners of the car base 50. However, any number of spacers 60 may be used, such as a single spacer 60, in order to allow for positioning of a car roof 100 thereof and for assembling brackets and hand railing 400 (See FIG. 5) to the car roof 100, as illustrated in FIGS. 2-5.

FIG. 1 illustrates the car base 50 substantially at a lower portion of the hoistway 10, however, the car base 50 maybe positioned at any position along the hoistway 10, such as the bottom of the hoistway 10 (i.e., the lowermost position) or the top of the hoistway 10 (i.e., the uppermost position).

Figure 2:
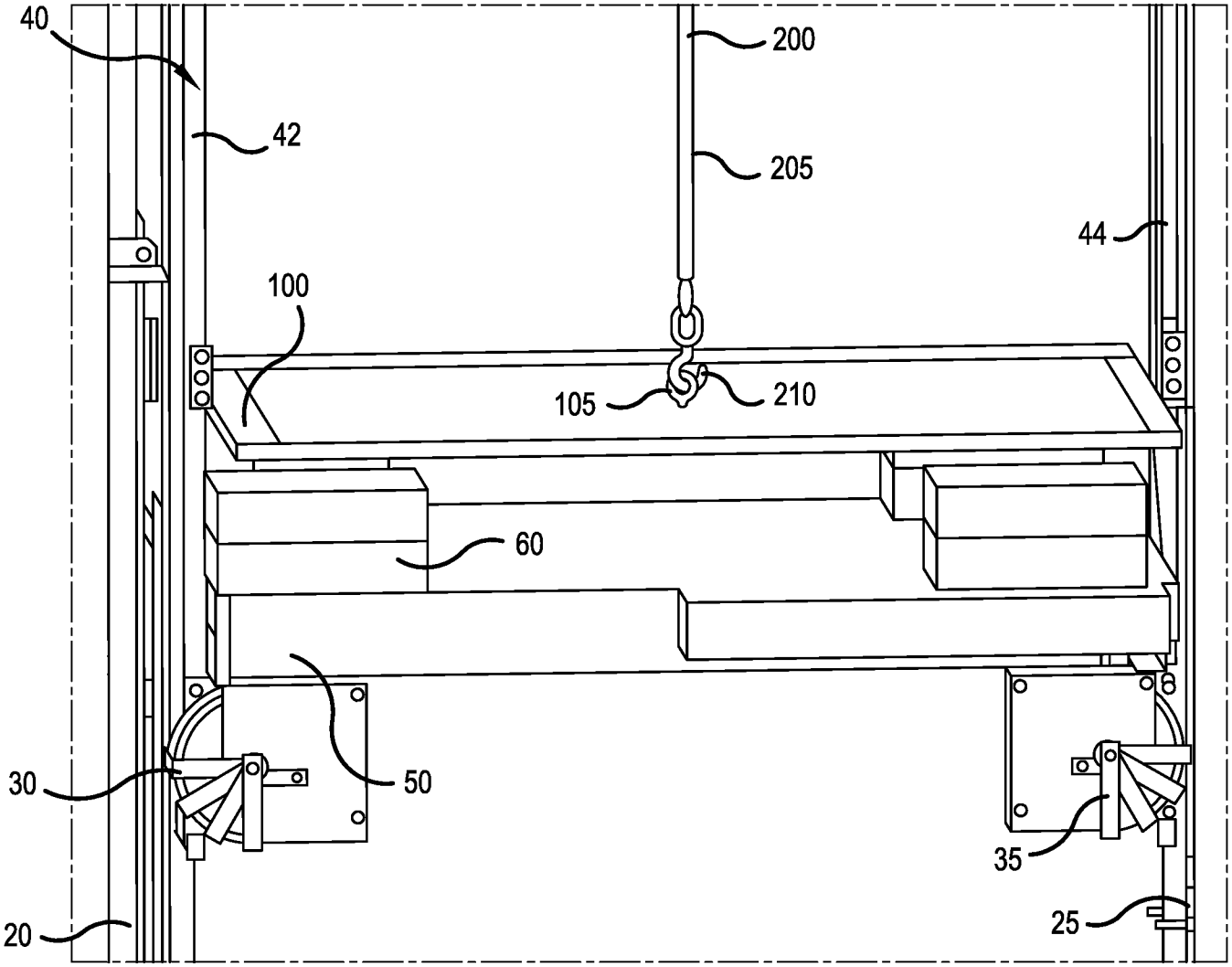
FIG. 2 is a perspective view of the elevator car being lowered onto the spacers of the car base.

FIG. 2 illustrates the lowering of the car roof 100 onto the at least one spacer 60 positioned on the top surface of the car base 50 via a hoist 200 connected via a first wire 205 and a hook 210 to an eyebolt 105 of the car roof 100.

The car roof 100 may be provided with kick plates 110 (See FIG. 3) on a top surface thereof. That is, the top surface of the car base 50 may be provided with kick plates 110 on each side of the car base 50. However, kick plates 110 may be provided on less than an entire periphery of the car roof 100, such as only three sides. That is, in use, one side of the elevator car may be substantially close to one surface of the elevator hoistway 10, thus obviating the need for hand railing 400 or kick plates 110 on the corresponding (i.e., adjacent) surface (i.e., periphery of the top surface or car roof 100) of the elevator car.

The kick plates 110 may be pre-installed on the car roof 100 in a closed position. In the closed position, the kick plates 110 may extend perpendicular (or substantially perpendicular) to the extension direction of the hoistway 10, which may also be parallel (or substantially parallel) with a top surface of the car roof 100. Alternatively, the kick plates 110 may be installed on the car roof 100 after the car roof 100 is positioned on the spacers 60.

That is, the kick plates 110 may be in a horizontal position that extends perpendicular to hoistway 10 and may be parallel to the top surface of the car base 50, the hoistway extending in a vertical direction.

Once the car roof 100 is set on the spacers 60, the kick plates 110 may be rotated to an open position that is parallel (or at least substantially parallel) with the vertical direction (i.e., parallel to the hoistway 10). Once in the open position, the kick plates 110 are fixed in position (i.e., in the open position) by fasteners, latches or the like. Alternatively, the kick plates 110 may be moved to their open position after fixing the car roof 100 to a top surface the car frame 40 or after installing hand railing 400 to the car roof 100.

A kick plate may be provided on each of any of the sides of the car roof 100, and may extend the entire periphery of the car roof 100, or may extend the periphery of the car roof 100 except for a portion of the car roof 100 adjacent to the guiderails 20, 25 to allow for installation of the brackets 120, 130, as described further below, and may extend any portion of the periphery of the car roof 100 except for a portion of the car roof 100 adjacent to the guiderails 20, 25 to allow for installation of the brackets 120, 130.

Figure 3:
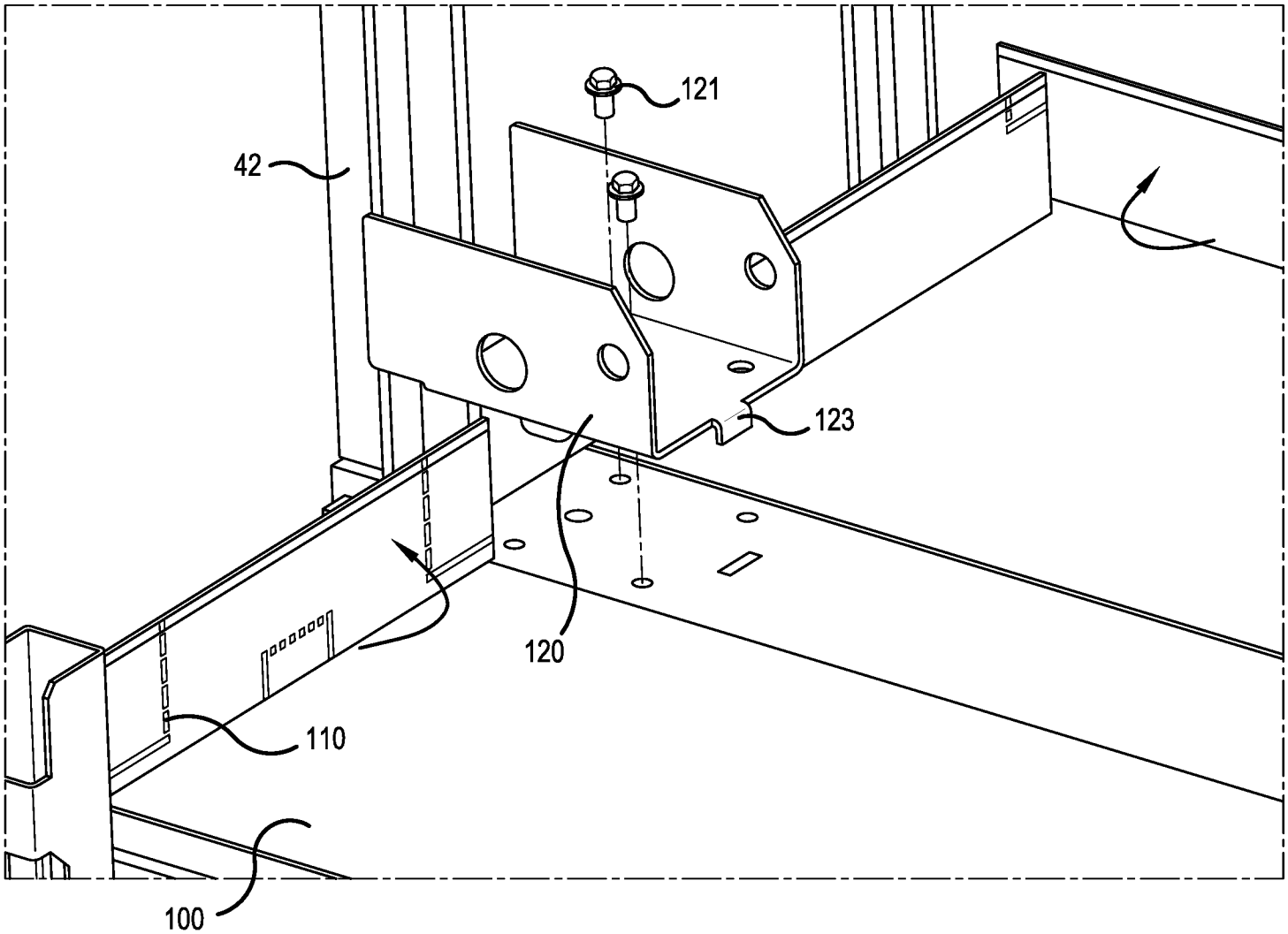
FIG. 3 is a perspective view of installing a bracket to the elevator car roof.

FIG. 3 illustrates the installation of a bracket 120, 130 onto the car roof 100 via fasteners. FIG. 3 shows two fasteners in the form of bolts 121, which threadingly engage a corresponding threaded aperture of the car roof 100, and a downwardly extending tab 123 of the bracket 120, 130 that is received in a corresponding slot of the car roof 100. Additional fasteners 121 may be used, and screws, rivets or the like maybe used as a replacement for bolts.

Figure 4:
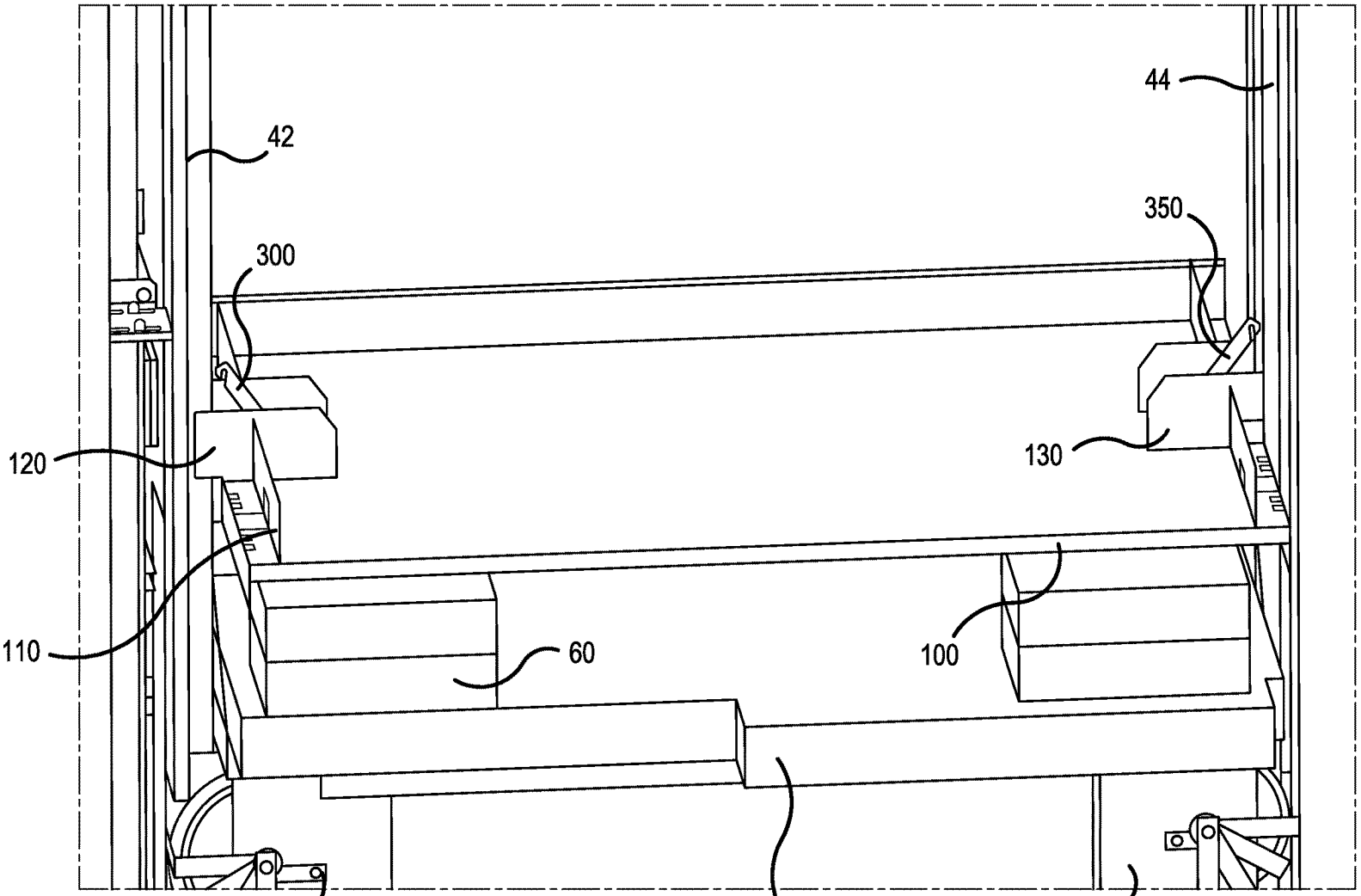
FIG. 4 is a perspective view of the car roof having brackets installed thereon and kick plates moved to their open position.

The brackets 120, 130 shown in FIG. 3 may be one of two brackets 120, 130 connected to the car roof 100, as shown in FIG. 4. That is, the brackets 120, 130 shown in FIG. 3 may be a first bracket 120, and a second bracket 130, as shown in FIG. 4, and may be connected to the car roof 100. Each bracket 120, 130 may be connected to a respective side of the car roof 100 adjacent to the respective vertical frame member 42, 44 (e.g., a vertical beam), to engage the respective vertical frame member 42, 44. The first bracket 120 may be connected to a first side of the car roof 100 adjacent to a first vertical frame member 42 and may slidingly engage a first vertical frame member 42. The first bracket 120 may extend in a space formed by two adjoining kick plates 110.

The second bracket 130 may be connected to a second side of the car roof 100 adjacent to a second vertical frame member 44 and may slidingly engage a second vertical frame member 44. The second bracket 130 may extend in a space formed by two adjoining kick plates 110.

Each bracket 120, 130 may have a substantially "U" shaped profile, including a base 126 and two upright arms 128 extending vertically and horizontally from respective ends of the base 126. When the bracket 120, 130 is installed in the hoistway 10, the upright arms extend in a vertical direction and have extension portions that extend past to the base 126 in a horizontal direction toward the respective vertical frame member 42, 44 to engage the respective vertical frame member 42, 44. Further, the extension portions of the upright arms may engage (e.g., slidingly engage) side surfaces of the respective vertical frame member 42, 44 and the base 126 may engage (e.g., slidingly engage) a front surface of the respective vertical frame member 42, 44. The front surface of the respective vertical frame member 42, 44 may face the car roof 100.

Figure 7A:
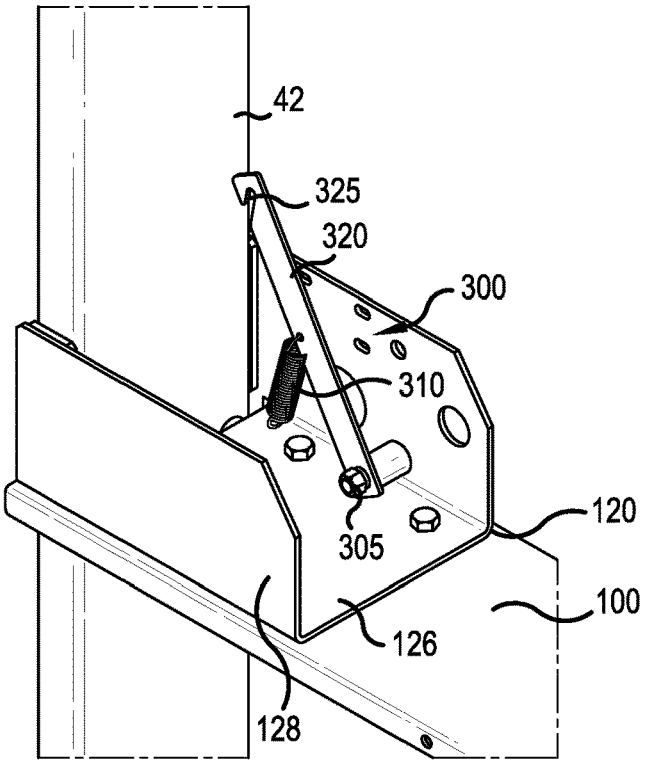
FIG. 7A is a perspective view of one of the brackets while the roof is being lifted and FIG. 7B is a side view of one of the brackets while the roof is being lifted.
Figure 8:
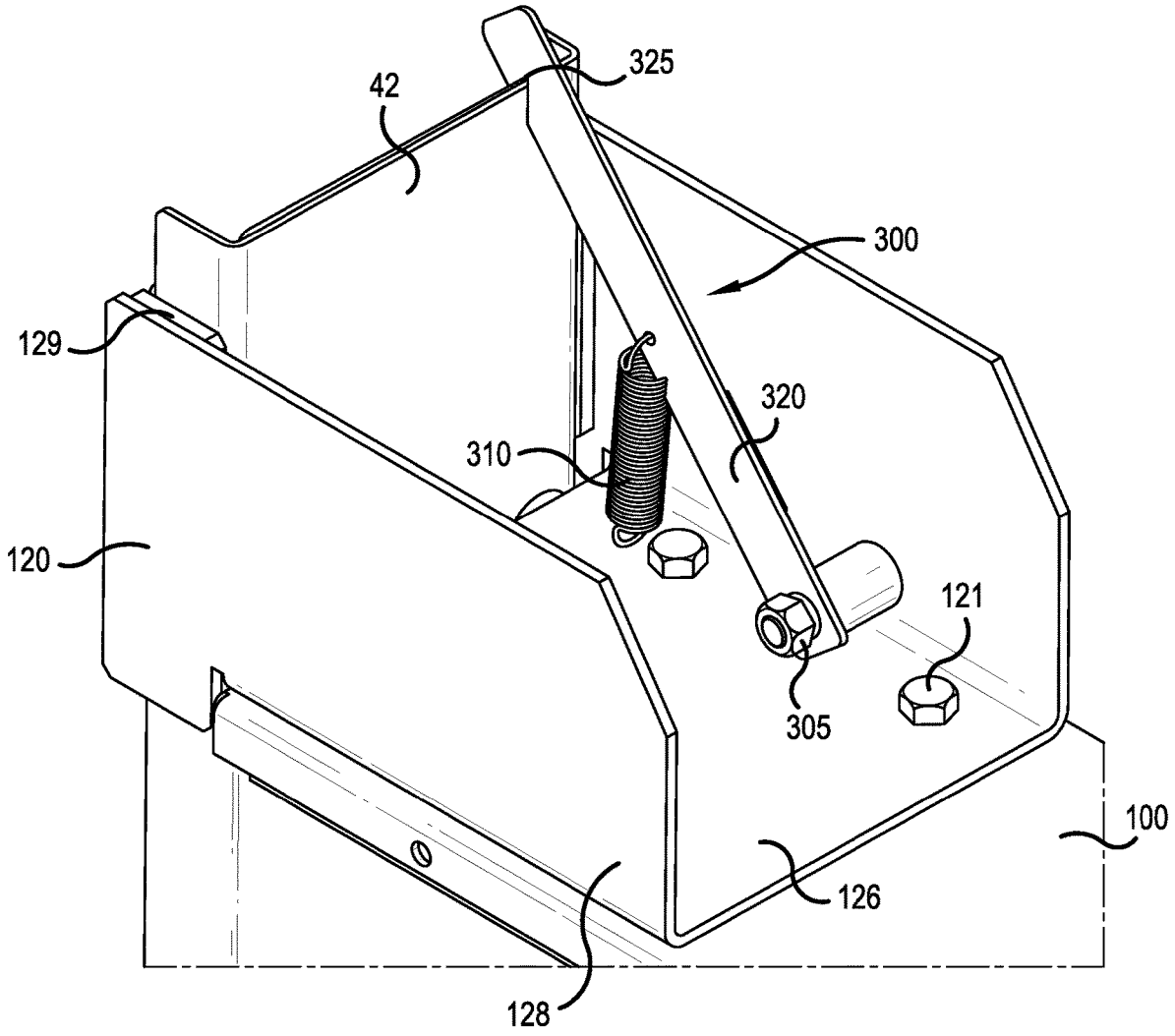
FIG. 8 is a perspective view of one of the brackets being attached to a vertical frame member via the safety latch.

The upright arms 128 and the base 126 of each bracket 120, 130 may include friction reducing members 129 to allow the brackets 120, 130 to slide along the respective vertical frame member 42, 44 as the roof 100 is being lifted to the top position (i.e., its installation position/the top most position of the car frame 40 for installing the car roof 100 to the car frame 40). The friction reducing member 129 may be comprised of PVC, nylon, polytetrafluoroethylene (PTFE), polyimide, polyetheretherketone (PEEK), polyphenylensulfide (PPS), nylon, acetal, polyester or similar materials. Further, the friction reducing members 129 may be comprised of metal, such as steel, and the metal may be coated with a lubricant, such as a lithium grease. The friction reducing members 129 are shown in FIGS. 7A and 8.

Further, as shown in FIG. 3, the kick plates 110 are located to the side of the brackets 120, 130 and do not extend in a location of the car roof 100 adjacent to the vertical frame members 42, 44. That is, the brackets 120, 130 are provided in a space between two adjacent kick plates 110.

FIG. 3 also shows arrows indicating the rotation of the kick plates 110 from the closed position to the open position (i.e., the final position). That is, the kick plates 110 are rotated and fixed in their open position to provide a safeguard for individuals standing on the car roof 100 for installation of various elevator-related items.

FIG. 4 illustrates a perspective view of the car roof 100 with the brackets 120, 130 installed and the kick plates 110 fixed in the open position, as described above. Further, FIG. 4 illustrates the brackets 120, 130 after installation of the safety latches 300, 350 thereto. The safety latches 300, 350 are shown in detail in FIGS. 7A, 7B and 8 and are described in detail below. The safety latches 300, 350 may be installed to the brackets 120, 130 after the brackets 120, 130 are connected to the car roof 100. Alternatively, the safety latches 300, 350 may be pre-installed to the brackets 120, 130 before the brackets 120, 130 are connected to the car roof 100 to simplify assembly of the elevator car.

Figure 5:
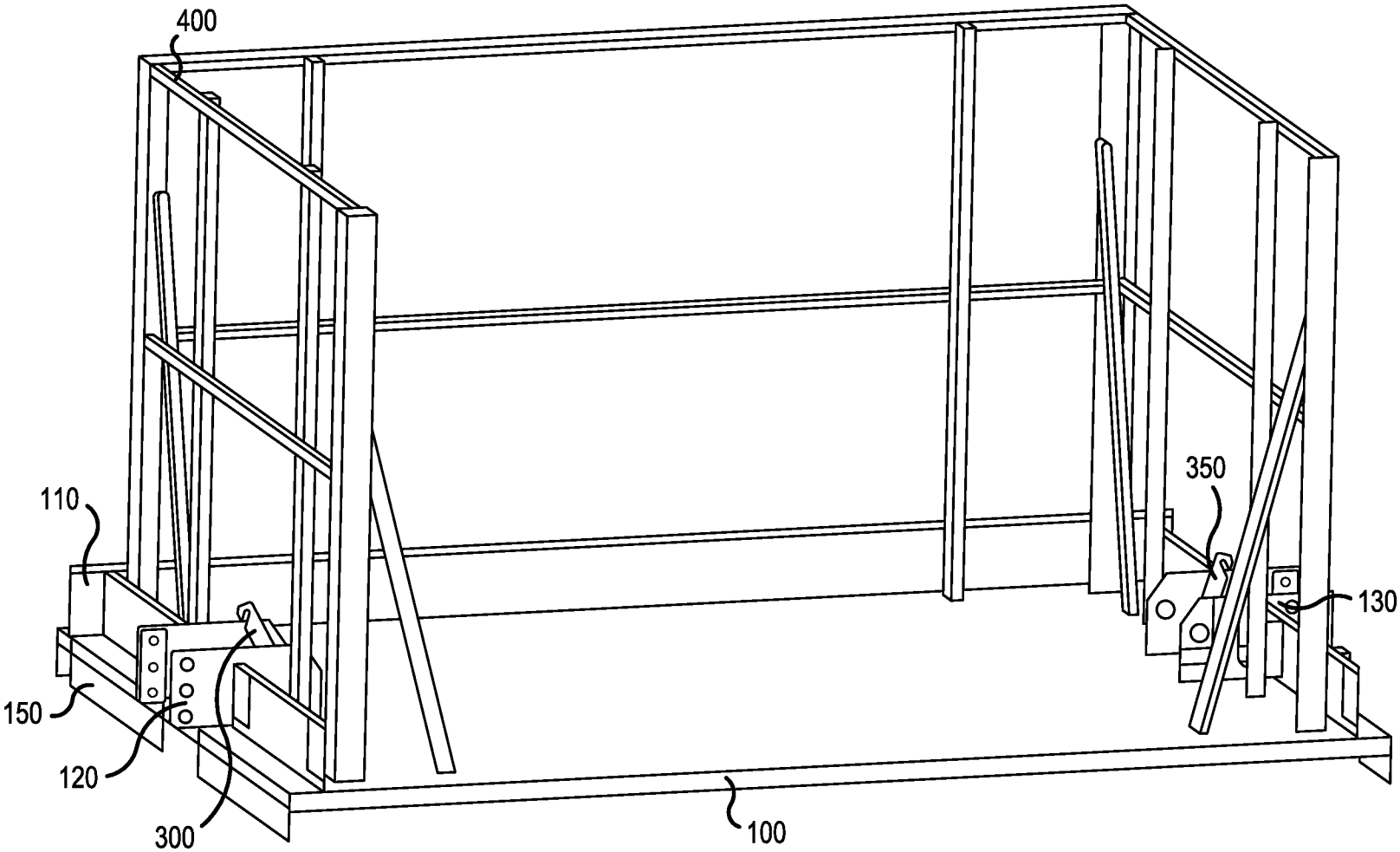
FIG. 5 is a perspective view of the car roof after installing the railing.

FIG. 5 illustrates the car roof 100 with hand railing 400 (i.e., balusters) installed. The hand railing 400 may be comprised of any known material, such as metal or plastic, that is sufficient to restrain the weight of an individual (i.e., worker or installer) standing on the car roof 100. That is, the hand railing 400 may be made of material of sufficient strength to support the weight of an individual standing on the car roof 100, which may occur during the installation of an elevator component, such as a landing.

Figure 9:
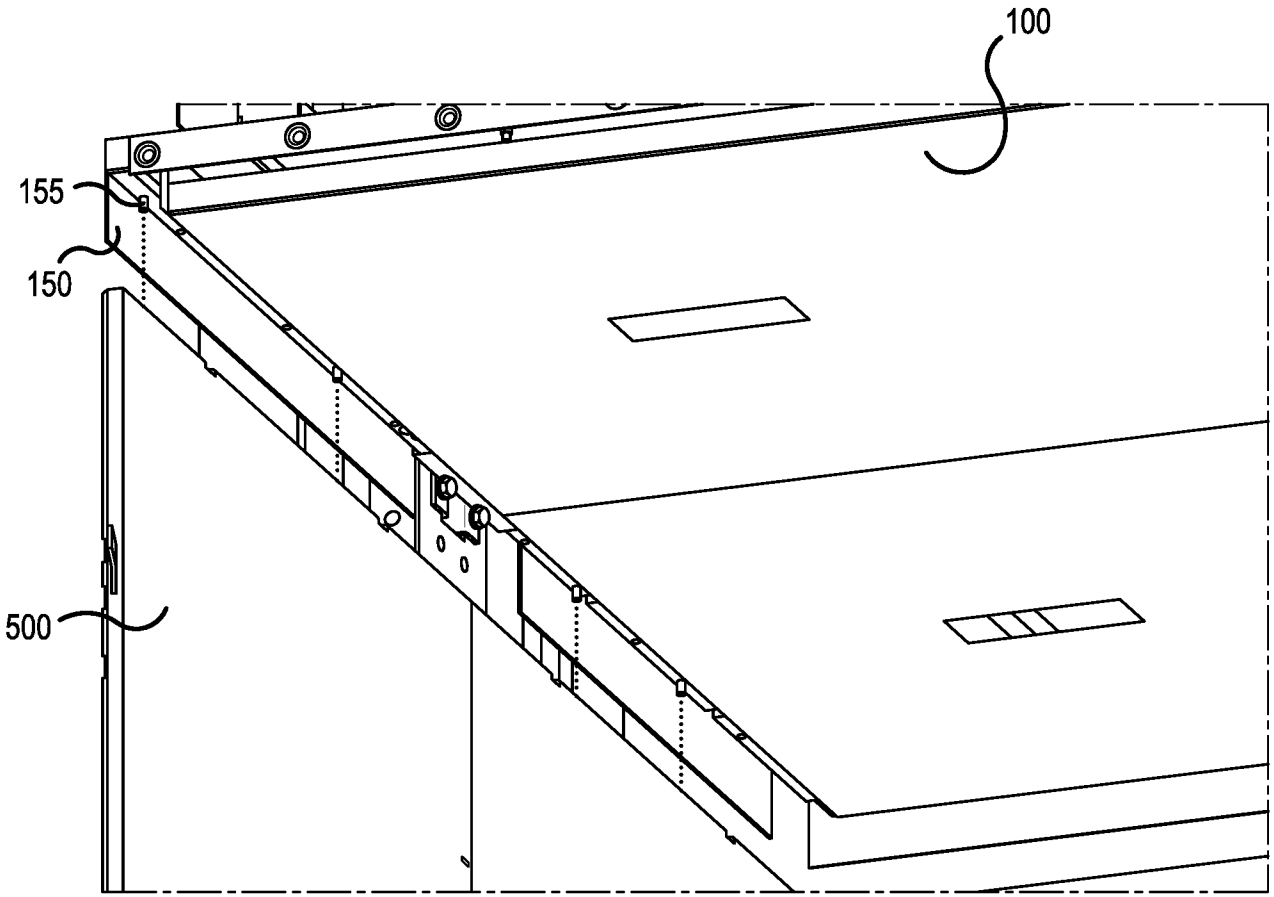
FIG. 9 is a perspective view of assembling a wall panel to the car roof and illustrating the guide plates of the car roof.

The car roof 100 may also include guides plates 150 extending downwardly from at least one side surface of the car roof 100. That is, the side surface of the car roof 100 may be parallel to the hoistway, and the guide plates 150 may be used for guiding wall panels 500 into position for attachment to the car roof 100, as illustrated in FIG. 9 and described further below. As shown in FIG. 5, the car roof 100 may include a plurality of guide plates 150 spaced apart from one another by the brackets 120, 130.

Further, the guide plates 150 may be provided at each of the side surfaces of the car roof 100 for guiding corresponding wall panels 500. Alternatively, the guide plates 150 may be provided on fewer than each of the side surface of the car roof, including not being provided at a front surface of the elevator car which coincides with a landing and/or elevator car door. That is, an elevator car door (or doors) may be installed on a first side of the elevator car, and the first side of the elevator car may lack guide plates 150 and wall panels 500.

The hand railing 400 may extend vertically from the car roof 100 by any distance, including a predetermined distance to enclose an individual standing on the roof 100, to protect the individual from failing from the car roof 100 down the hoistway 10. That is, the hand railing 400 may extend a predetermined height, such as a three (3) feet or four (4) feet from the car roof 100, as a form of fall protection to protect an individual standing on the car roof 100 from falling from the car roof 100. The hand railing 400 may be attached to the car roof 100 by bolts, screws, riveting, brazing, welding, or any other known method.

The hand railing 400 is attached to the car roof 100 before the car roof 100 is raised and installed to the car frame 40 in order to simplify installation. Further, since the car base 50 is preferably provided at a bottom of the hoistway 10 during the installation of the railing 400, the individual(s) may be provided additional safety by limiting the potential falling height.

Figure 6:
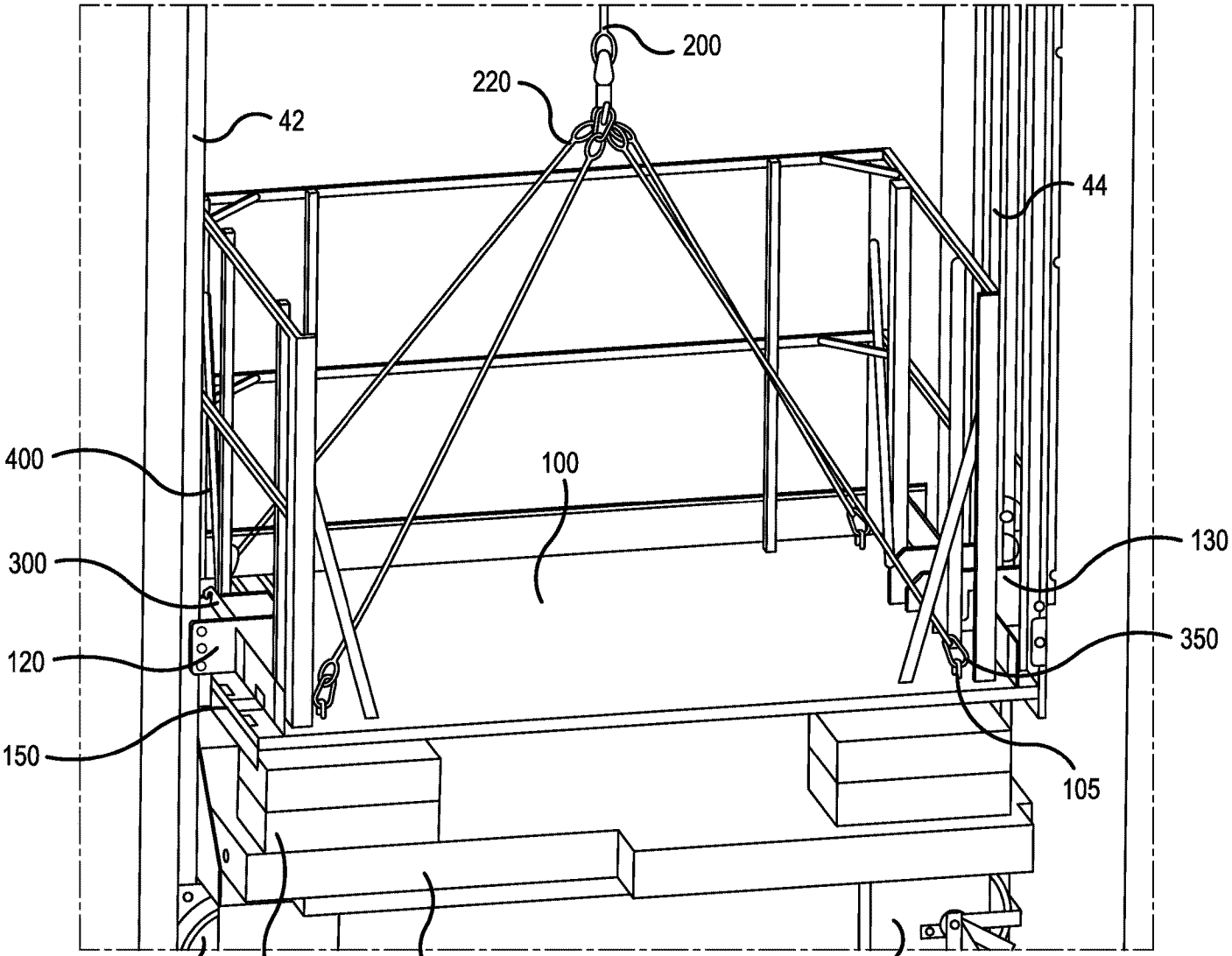
FIG. 6 is a perspective view of the car roof being lifted within the hoistway.

FIG. 6 is a perspective view of a hoist and hoisting rope for lifting the car roof 100 for installation of the car roof 100 to the car frame 40. Specifically, one or more eyebolts 105 may be installed on the car roof 100 by threadingly engaging a respective threaded (female) aperture of the car roof 100. There may be four eyebolts 105, as shown in FIG. 6, one eyebolt located at each corner of the car roof 100, for evenly distributing the weight of the car roof 100 to a centrally located lifting hoist 200, via ropes 220. That is, the lifting hoist may be connected to the one or more eyebolts via rope, wires or the like, and may be located at (i.e., above) a center of the roof 100 (as viewed from the vertical direction). However, the lifting hoist 200 may be positioned at any location within the hoistway 10. Alternatively, any other mechanical means, such as a crane, a motor, a winch, or any known engine may be used to lift the car roof 100.

FIG. 7A is a perspective view of the car roof 100 while being lifted. For illustration purposes only and to emphasis the action of the safety latch lever arm 300, as the roof 100 lifts and the bracket 120, 130 engages a respective vertical frame member 42, 44, only a portion of the roof 100 is shown.

Although FIG. 7A only illustrates one bracket 120, 130 and one vertical frame member 42, 44, it is understood that an opposite side of the car roof 100 includes a second bracket 130 and second vertical frame member 44 having the same structure and function.

During lifting of the car roof 100, the safety latch lever arm 320 (herein "lever arm") of each bracket 120, 130 is biased by a respective spring 310 towards a respective vertical frame member 42, 44 of the car frame 40, and may either be spaced from or slide against the respective vertical frame member 42, 44 during lifting. As shown in FIG. 7A, the spring 310 may be attached at one end to the respective bracket 120, 130 and at the other end to the respective lever arm 320.

A first end of each spring 310 (of each bracket 120, 130) may be attached to a hole of the respective bracket 120, 130 and a second end of the spring 310 may be attached to a hole (i.e., aperture) of the respective lever arm 320. For instance, the first end of the spring 310 may be bent so as to engage a bottom surface of the respective bracket 120, 130, opposite the illustrated top surface of the respective bracket 120, 130, or to engage a corresponding hole (i.e., aperture) of the car roof 100. The second end of the spring 310 may also be bent to engage and wrap around a hole (i.e., aperture) of the respective lever arm 320, by engaging multiple surfaces of the respective lever arm 320, including a front longitudinal face and a rear longitudinal face, to thereby fix the spring 310 to the respective lever arm 320.

Each spring 310 may be attached to any location of the respective bracket 120, 130, however, FIG. 7A illustrates the spring 310 being positioned along a same plane as the respective lever arm 320 to bias the lever arm 320 along the plane, to allow the lever arm 320 to engage a top surface of the respective vertical frame member 42, 44 once the car roof 100 is raised to the appropriate height (i.e., its desired installed height).

The second surface of each spring 310 may be attached to any position of the respective lever arm 320, however, is shown in FIG. 7A as being attached to a longitudinal center of the respective lever arm 320.

A first end of each lever arm 320 may be attached to the bracket 120, 130 via a fastener 305 and may be rotatable with respect to the corresponding bracket 120, 130 by the first end. FIG. 7A illustrates a lever arm 320 attached to the bracket 120, 130 by a fastener passing through an aperture of the lever arm 320 and engaging a protrusion of the bracket 120, 130, and a nut attached to the fastener. However, any other known mechanical connection may be employed that allows the lever arm 320 to be connected to and rotate about the corresponding bracket 120, 130.

A second end of each lever arm 320 may include a groove 325 for engaging a top surface of the respective vertical frame member 42, 44. The groove 325 may be a predetermined shape to match the shape of the top surface of the respective vertical frame member 42, 44, such that upon engagement of the groove 325 to the top surface of the respective vertical frame member 42, 44, the lever arm 320 is locked in place. That is, the lever arm 320, once engaged with the top surface of the vertical frame member 42, 44, engages multiple surface of the vertical frame member 42, 44, such as a front surface, a top surface, and a rear surface, to lock the car roof 100 in place and allow for safely fastening of the car roof 100 to the car frame 40.

Thus, the safety latch of the present application allows the car roof 100 to automatically engage and be locked to the respective vertical frame member 42, 44 due to the biasing force of the spring 310 and the groove 325 of the lever arm 320, thereby allowing for installation of the car roof 100 without needing to maintain a lifting force during assembly of the wall panels, such as by the hoist shown in FIG. 6, thereby simplifying installation of the car roof 100.

Figure 7B:
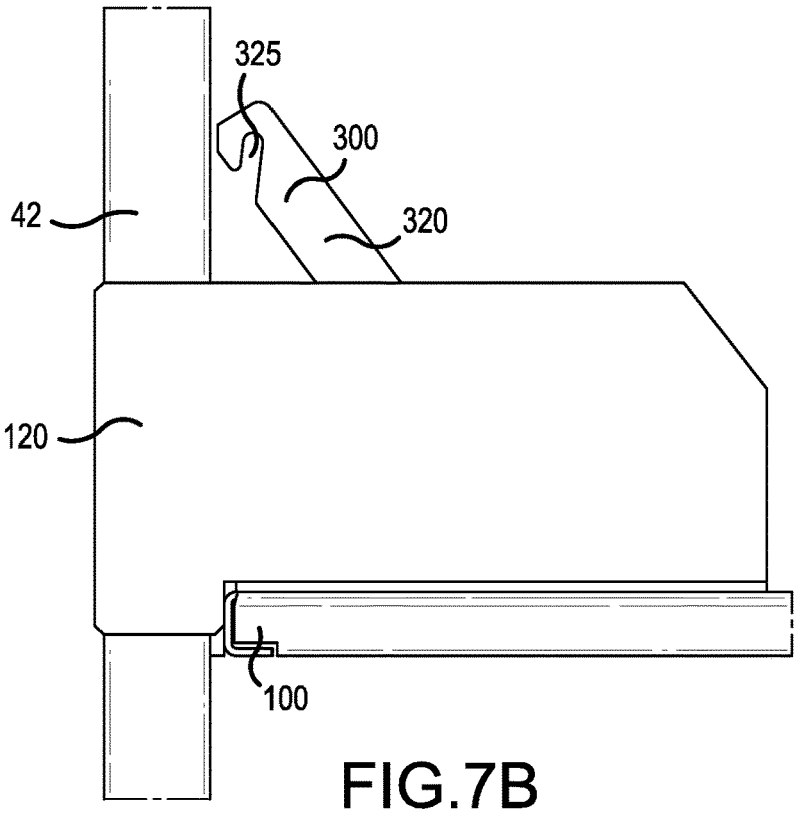

FIG. 7B is a side view of the safety latch during lifting of the car roof 100. Although the lever is illustrated as being spaced from the respective vertical frame member 42, 44, during lifting of the car roof 100, the lever arm 320 will slidingly engage the respective vertical frame member 42, 44, due to the biasing force of the spring 310, in order to allow for engagement with the respective top surface of the vertical frame member 42, 44.

That is, the spring 310 should bias the lever arm 320 against the vertical frame member 42, 44 such that the lever arm 320 slides against the vertical frame member 42, 44 while the car roof 100 is raised.

Further, during lifting the car roof 100, the spring 310 may allow the lever arm 320 to rotate if it encounters a fastener or any other member. That is, the spring 310 may allow the lever arm 320 to rotate away from the vertical frame member 42, 44 (i.e., towards a center of the car roof 100), to prevent damage to the lever arm 320.

FIG. 8 illustrates the lever arm 320 engaging a top surface of the respective vertical frame member 42, 44. Although FIG. 8 illustrates only a single lever arm 320, both lever arms 320 of both safety latches 300, 350 (located on opposing sides of the car roof 100) will engage respective vertical frame members 42, 44. That is, the lever arm 320, biased by the spring 310 towards the respective vertical frame member 42, 44, will, once the top position of the car roof 100 (i.e., installation position) is reach, slide over the top surface of the respective vertical frame member 42, 44 until the groove 325 engages the top surface of the respective vertical frame member 42, 44.

As shown in FIG. 8, each lever arm 320 may engage multiple surfaces of the respective vertical frame member 42, 44 to lock the car roof 100 in place, thereby allowing for wall panels to be safely installed directly, or allow for the car roof 100 to be further attached to the car frame 40 without the need for maintaining a lifting force of the car roof 100 by an external means, such as by the lifting hoist shown in FIG. 6.

That is, the lever arm 320 may engage a front surface (i.e., facing a center of the car roof 100), a rear surface (opposite toe the front surface), and a topmost portion of the top surface of the respective vertical frame member 42, 44. In other words, the lever arm 320 may surround the top surface of the respective vertical frame member 42, 44 and be held in place by the force of gravity.

FIG. 9 is a perspective view of attachment of a wall panel to the car roof 100. The car roof 100 may be provided with guide plates 150 extending downwardly to guide the wall panels into their correct position. The guide plates 150 are also shown in FIG. 5 extending a portion of a side surface of the roof 100. However, the guide plates 150 may extend the entire side surface of the roof 100.

Further, the car roof 100 may be provided with guide pins 155 protruding downwardly (i.e., protruding outwardly from a bottom surface of the car roof 100) to engage corresponding holes of the wall panel, thereby locating the wall panel with respect to the car roof 100 to allow for fastening of the wall panel to the car roof 100.

Once the wall panels are properly located (i.e., connected via the guide pins 155) to the car roof 100, the wall panels may be fastened to the car roof 100 by any known means, including bolts, screws, rivets, or the like. The guide plates 150 may cover an outer surface of the wall panels and may abut against an outer surface of the wall panels once installed.

Further, the wall panels may be installed to a car base 50 by any known means, such as by bolts, screws, rivets or the like. U.S. Pat. No. 4,430,835 (herein "Ericson"), which is incorporated by reference in its entirety, describes a process of attaching wall panels, and other car components to one another. Further, U.S. Pat. No. 4,779,707 (herein "Smith"), which is incorporated by reference in its entirety, describes an alternate method for attaching wall panels to a car base and to a car roof 100, including the utilization of brackets 120, 130, fasteners, "channels 66 and cooperating nuts 68, springs 72 and bolts 74" (Smith column 5, lines 43 and 44). Further, Starace (noted above), described a modular connection between the wall panels, the car roof 100 and the car base (i.e., car floor), see Starace Abstract, FIGS. 1, 2 and 6-12 and column 2, lines 27-61.

The wall panels, car base, and car roof 100 of the present invention may comprise metal, plastic, or may be panels comprising multiple materials, such as "expanded core plastic . . . [that] consist of two sections . . . butted together in a single panel" (Ericson column 2, lines 51-59).

Figure 10:
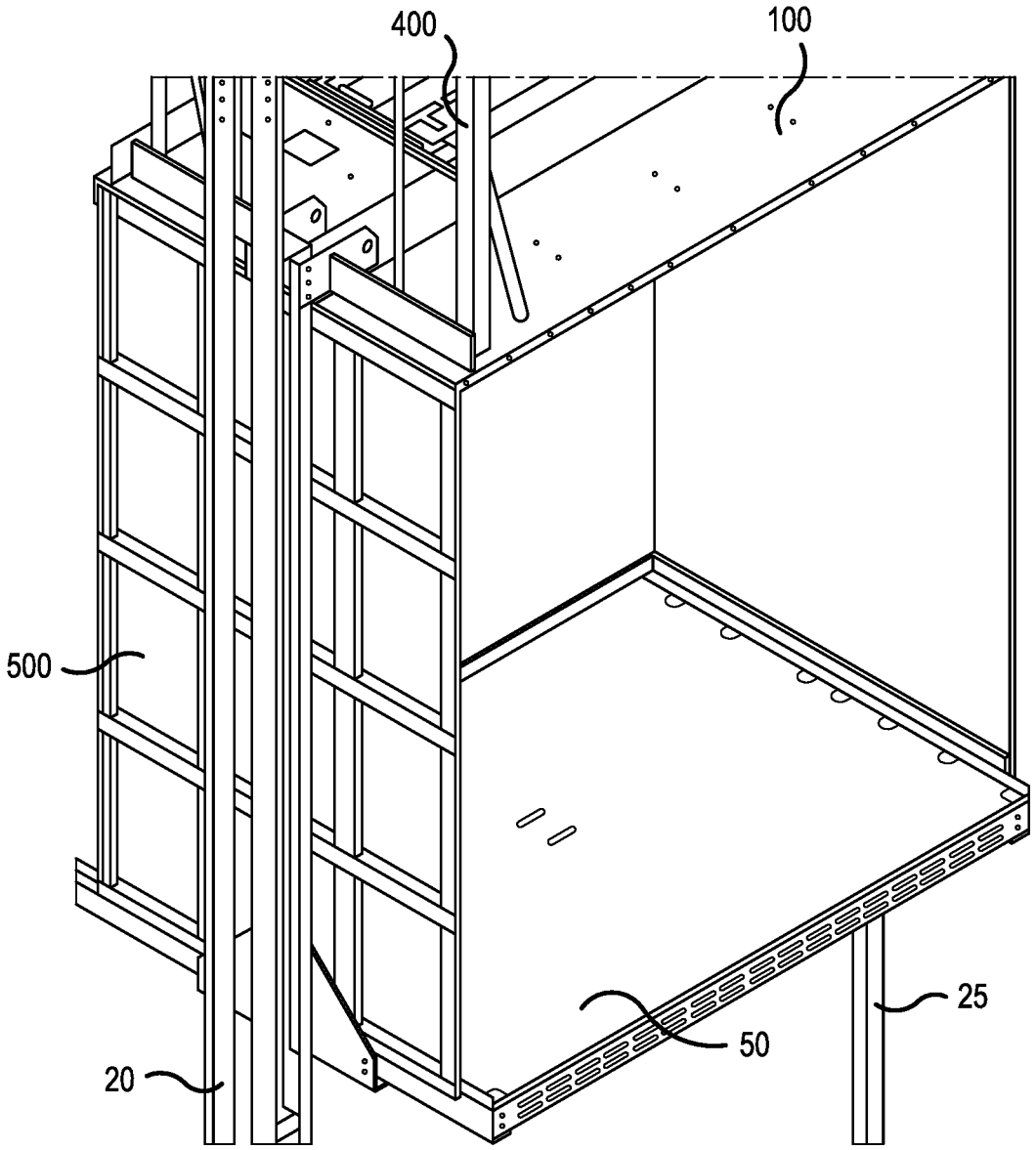
FIG. 10 is a partially completed elevator car having the wall panels installed thereon.

FIG. 10 illustrates the completed elevator car with each of the wall panels installed in the manner described above. Once the wall panels are installed, the safety latches 300, 350 may remain connected to the car frame 40, or may be disconnected. Further, to allow to car frame 40 to move with respect to the guide rails, the temporary fixing means employed to allow for the construction of the elevator car may be removed, and the car frame 40 may be movably attached to the guide rails 20, 25 by any known means.

Once the elevator car is complete, additional components of the elevator may be installed. For example, a hoist may be installed (i.e., attached) to the car roof 100, ropes may be attached to the diverter pulleys of the elevator car, and a drive machine (e.g., drive motor, as known in the art) and a traction sheave may be assembled in the elevator hoistway for driving the elevator car. The elevator assembly may be installed within the elevator hoistway in the manner described in US 2002/0066622 (herein "Pettersson"), which is incorporated by reference in its entirety.

The disclosure of which described above is not limited to the materials and features described therein, and may be changed within the scope of one ordinary skill in the art.

What is claimed is:

1. A method of assembling an elevator car within an elevator hoistway, including:

installing a car frame onto the elevator hoistway;

attaching a car base to the car frame, the car base forming a floor of the elevator car;

setting spacers on a top surface of the car base;

positioning a car roof onto the spacers, the car roof including a first and a second bracket, wherein each of the first bracket and the second bracket includes a safety latch assembly; and lifting the car roof to a top position in which each safety latch assembly engages a respective top surface of the car frame to fix the car roof to the car frame, wherein each safety latch assembly includes an arm and a spring attached to the arm, and wherein during lifting of the car roof, the arm of each safety latch assembly slides along the car frame.

2. The method of claim 1; wherein the first bracket is fixed to a first side of the car roof, and the second bracket is fixed to a second side of the car roof, the first side of the car roof being opposite to the second side of the car roof.

3. The method of claim 1, wherein each of the first bracket and the second bracket has a U-shaped profile and includes:

a base;

a first wall extending vertically from a first end of the base;

a second wall extending vertically from a second end of the base, wherein the first end of the base is opposite to the second end of the base; and a guide protrusion, wherein the guide protrusion of each bracket engages a corresponding aperture of the car roof and each bracket is attached to the car roof with at least one fastener.

4. The method of claim 3, wherein each of the first bracket and the second bracket surrounds a respective vertical beam of the car frame, and wherein each of the first bracket and the second bracket contacts side portions of the respective vertical beam during the lifting of the car roof to the top position.

5. The method of claim 4, wherein each of the first bracket and the second bracket contacts the side portions of the respective vertical beam by a friction release member.

6. The method of claim 5, wherein for each bracket:

the friction release member is a first friction release member and each bracket further includes a second friction release member and a third friction release member, the first friction release member engages a first side surface of the respective vertical beam and the second friction release member engages a second side surface of the respective vertical beam, the second side surface being opposite to the first side surface, and the third friction release member engages a front surface of the respective vertical beam facing the car roof, the front surface of the respective vertical beam is perpendicular to the first side surface and the second side surface of the respective vertical frame member.

7. The method of claim 1, wherein each spring provides an elastic biasing force to the respective arm to allow the arm to slide along the car frame.

8. The method of claim 1, where each arm includes a groove extending orthogonal to a longitudinal axis of each arm, and wherein the groove of each arm engages the respective top surface of the car frame and side surfaces of the car frame.

9. The method of claim 1, wherein the car frame is attached to opposing guide rails of the elevator hoistway, and wherein the car base includes diverter pulleys.

10. The method of claim 1, further comprising after each safety latch assembly engages a respective top surface of the car frame, assembling the car walls to the car base and to the car roof.

11. The method of claim 1, wherein the car roof includes kick plates hingedly connected to a perimeter of a top surface of the car roof, wherein the method further comprises rotating the kick plates from a horizontal position to a vertical position, and wherein in the vertical position, the kick plates are perpendicular to the top surface of the car roof.

12. The method of claim 11, wherein after rotating the kick plates, the kick plates are fixed to the car roof via fasteners, wherein the method further comprises installing a railing on the car roof, and wherein the installing of the railing is performed prior to lifting the car roof.

13. A method of assembling an elevator car within an elevator hoistway, including:

attaching a car base to a car frame provided within the elevator hoistway;

setting spacers on top of the car base;

placing a car roof onto the spacers, the car roof including a first bracket and a second bracket, each bracket including a safety latch assembly; and lifting the car roof to a top position where each safely latch assembly engages a respective top surface of the car frame to fix the car roof to the car frame, wherein each safety latch assembly includes an arm and a spring attached to the arm, and wherein during lifting of the car roof, the arm of each safety latch assembly slides along the car frame.

14. The method of claim 13, wherein each spring provides an elastic biasing force to the respective arm to allow the arm to slide along the car frame.

15. The method of claim 14, where each arm includes a groove extending orthogonal to a longitudinal axis of each arm, and wherein the groove of each arm engages the respective top surface of the car frame and side surfaces of the car frame.

16. The method of claim 14, wherein the car roof includes kick plates hingedly connected to a perimeter of a top surface of the car roof, wherein the method further comprises rotating the kick plates from a horizontal position to a vertical position, and wherein in the vertical position, the kick plates are perpendicular to the top surface of the car roof.

17. An elevator car roof; comprising:

a planar top surface; and a bracket attached to the top surface;

wherein the bracket includes a safety latch assembly, wherein the safety latch assembly is configured to automatically engage a top surface of a car frame to fix the elevator car roof to the car frame, wherein each safety latch assembly includes an arm and a spring attached to the arm, and wherein each spring provides an elastic biasing force to the respective arm to allow the arm to slide along the car frame during lifting of the car roof.

* * * * *